US010322594B2

(12) United States Patent
Nakano et al.

(10) Patent No.: US 10,322,594 B2
(45) Date of Patent: Jun. 18, 2019

(54) RECORDING MEDIUM AND MANUFACTURING METHOD OF RECORDING MEDIUM

(71) Applicant: Kabushiki Kaisha Toshiba, Minato-ku (JP)

(72) Inventors: Takahisa Nakano, Kawasaki (JP); Fumitoshi Morimoto, Shirakawa (JP); Nobuki Nemoto, Kawasaki (JP); Satoru Abe, Yokohama (JP)

(73) Assignee: Kabushiki Kaisha Toshiba, Minato-ku (JP)

( * ) Notice: Subject to any disclaimer, the term of this patent is extended or adjusted under 35 U.S.C. 154(b) by 0 days.

(21) Appl. No.: 15/451,595

(22) Filed: Mar. 7, 2017

(65) Prior Publication Data

US 2017/0253065 A1 Sep. 7, 2017

(30) Foreign Application Priority Data

Mar. 7, 2016 (JP) ..... 2016-043721

(51) Int. Cl.
*B41M 5/50* (2006.01)
*B05D 1/00* (2006.01)
(Continued)

(52) U.S. Cl.
CPC ..... *B41M 5/502* (2013.01); *B05D 1/00* (2013.01); *B41M 5/30* (2013.01); *B41M 5/42* (2013.01);
(Continued)

(58) Field of Classification Search
None
See application file for complete search history.

(56) References Cited

U.S. PATENT DOCUMENTS 4,897,669 A * 1/1990 Akutsu ..... B41J 31/05 347/199
7,768,540 B2 * 8/2010 Busch ..... B41J 2/355 347/173
(Continued)

FOREIGN PATENT DOCUMENTS

EP 1 878 587 A1 1/2008
EP 2 554 392 A1 2/2013
(Continued)

OTHER PUBLICATIONS

Extended European Search Report dated Aug. 7, 2017 in European Patent Application No. 17159566.3.

*Primary Examiner* — Alejandro Valencia
(74) *Attorney, Agent, or Firm* — Oblon, McClelland, Maier & Neustadt, L.L.P.

(57) ABSTRACT

A recording medium has a substrate and a first color developing layer, a heat insulating layer and a second color developing layer laminated on the substrate in this order. The first color developing layer develops a first color at a temperature not less than a first threshold value. The second color developing layer develops a second color that is different from the first color at a temperature not less than a second threshold value that is higher than the first threshold value. The heat insulating layer has a first heat insulating layer of a first heat conductivity and a second heat insulating layer of a second heat conductivity that is higher than the first heat conductivity, which are laminated in a second direction orthogonal to a first direction in which the first color developing layer, the heat insulating layer, and the second color developing layer are laminated on the substrate.

2 Claims, 4 Drawing Sheets

(51) Int. Cl.

| | |
|---|---|
| ***B41M 5/30*** | (2006.01) |
| ***B41M 5/42*** | (2006.01) |
| *B41M 5/34* | (2006.01) |

(52) U.S. Cl.
CPC ..... *B41M 5/34* (2013.01); *B41M 2205/04* (2013.01); *B41M 2205/38* (2013.01)

(56) References Cited

U.S. PATENT DOCUMENTS

| | | | |
|---|---|---|---|
| 2004/0265552 | A1 | 12/2004 | Lutz et al. |
| 2008/0008963 | A1 | 1/2008 | Tamura et al. |
| 2010/0062195 | A1 | 3/2010 | Masuda |
| 2010/0087316 | A1 | 4/2010 | Day et al. |
| 2012/0083565 | A1 | 4/2012 | Day et al. |
| 2013/0053240 | A1 | 2/2013 | Takahama et al. |
| 2013/0303670 | A1 | 11/2013 | Day et al. |

FOREIGN PATENT DOCUMENTS

| | | | |
|---|---|---|---|
| JP | 3509246 | B2 | 3/2004 |
| JP | 2005-138558 | A | 6/2005 |
| JP | 4091423 | B2 | 3/2008 |

* cited by examiner

COMPARATIVE EXAMPLE

RECORDING MEDIUM AND MANUFACTURING METHOD OF RECORDING MEDIUM

CROSS-REFERENCE TO RELATED APPLICATION

This application is based upon and claims the benefit of priority from the prior Japanese Patent Application No. 2016-043721, filed on Mar. 7, 2016, the entire contents of which are incorporated herein by reference.

FIELD

Embodiments of the present invention relate to a recording medium and a manufacturing method of a recording medium.

BACKGROUND

There are methods which, at the time of irradiating a recording medium in which a plurality of color developing layers of which threshold values of color developing temperature are different are laminated with laser light, form a full color image by varying strength of the laser light and an exposure time to the laser light in accordance with color to be developed.

Laser light with which a recording medium is irradiated is converted into heat, and the heat is propagated within the recording medium. The heat is propagated not only in a lamination direction in which color developing layers are to be laminated, but also in a direction orthogonal to the lamination direction. For this reason, as the heat is propagated from a laser spot of the laser light formed on the recording medium toward the inside of the recording medium, the heat is diffused in the direction orthogonal to the lamination direction. Accordingly, an area in the color developing layer where color is developed becomes larger than an area of the laser spot, and as a result a desired image cannot be formed.

EMBODIMENT TO PRACTICE THE INVENTION

A recording medium of an embodiment has a substrate, a first color developing layer, a heat insulating layer, and a second color developing layer. The first color developing layer is laminated on the substrate and develops a first color at a temperature not less than a first threshold value. The heat insulating layer is laminated on the first color developing layer. The second color developing layer is laminated on the heat insulating layer, and develops a second color that is different from the first color at a temperature not less than a second threshold value that is higher than the first threshold value. The heat insulating layer has a first heat insulating layer of a first heat conductivity and a second heat insulating layer of a second heat conductivity that is higher than the first heat conductivity, which are laminated in a second direction orthogonal to a first direction in which the first color developing layer, the heat insulating layer, and the second color developing layer are laminated on the substrate.

Hereinafter, a recording medium according to the present embodiment and a manufacturing method of the recording medium will be described using the accompanying drawings.

Figure 1:
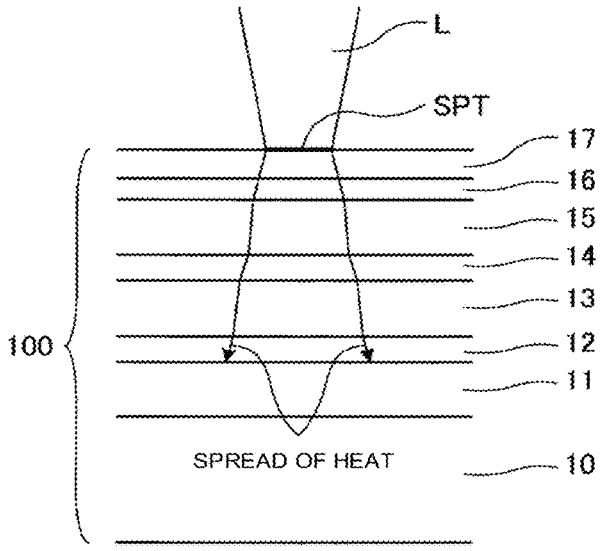
FIG. 1 is a diagram showing an example of a schematic configuration of a recording medium according to the present embodiment.

FIG. 1 is a diagram showing an example of a schematic configuration of a recording medium according to the present embodiment. As shown in FIG. 1, a recording medium 100 has a substrate 10, and a heat insulating layer 11, a cyan color developing layer 12, a heat insulating layer 13, a magenta color developing layer 14, a heat insulating layer 15, a yellow color developing layer 16, a protective layer 17 which are laminated on the substrate 10. The recording medium 100 is manufactured by laminating the heat insulating layer 11, the cyan color developing layer 12, the heat insulating layer 13, the magenta color developing layer 14, the heat insulating layer 15, the yellow color developing layer 16, the protective layer 17 on the substrate 10 in this order. The heat insulating layer 11 contains heat insulating material which decreases heat transfer from the cyan color developing layer 12 to the substrate 10. The cyan color developing layer 12 is a layer which is provided on the substrate 10 via the heat insulating layer 11 and contains temperature indicating material that develops cyan (an example of a first color) at a temperature not less than a low temperature threshold value t1 (an example of a first threshold value). The heat insulating layer 13 is provided between the cyan color developing layer 12 and the magenta color developing layer 14, and contains heat insulating material which decreases heat transfer from the magenta color developing layer 14 to the cyan color developing layer 12.

The magenta color developing layer 14 is a layer which is provided on the cyan color developing layer 12 via the heat insulating layer 13 and contains temperature indicating material that develops magenta (an example of the first color or a second color) at a temperature not less than an intermediate temperature threshold value t2 (an example of the first threshold value or a second threshold value) that is higher than the low temperature threshold value t1. The heat insulating layer 15 is provided between the magenta color developing layer 14 and the yellow color developing layer 16, and contains heat insulating material which decreases heat transfer from the yellow color developing layer 16 to the magenta color developing layer 14. The yellow color developing layer 16 is a layer which is provided on the magenta color developing layer 14 via the heat insulating layer 15 and contains temperature indicating material that develops yellow (an example of the second color) at a temperature not less than a high temperature threshold value t3 (an example of the second threshold value) that is higher than the intermediate temperature threshold value t2. The protective layer 17 is provided on the yellow color developing layer 16, and protects the heat insulating layers 11, 13, 15, the cyan color developing layer 12, the magenta color developing layer 14, and the yellow color developing layer 16.

The recording medium 100 of the present embodiment can reproduce a color of full colors by three colors of cyan which the cyan color developing layer 12 develops, magenta which the magenta color developing layer 14 develops, and yellow which the yellow color developing layer 16 develops. However, a recording medium of the present embodiment is not limited to the above-described structure, as long as a plurality of color developing layers which develop different colors at different temperatures are laminated via a heat insulating layer.

Figure 2:
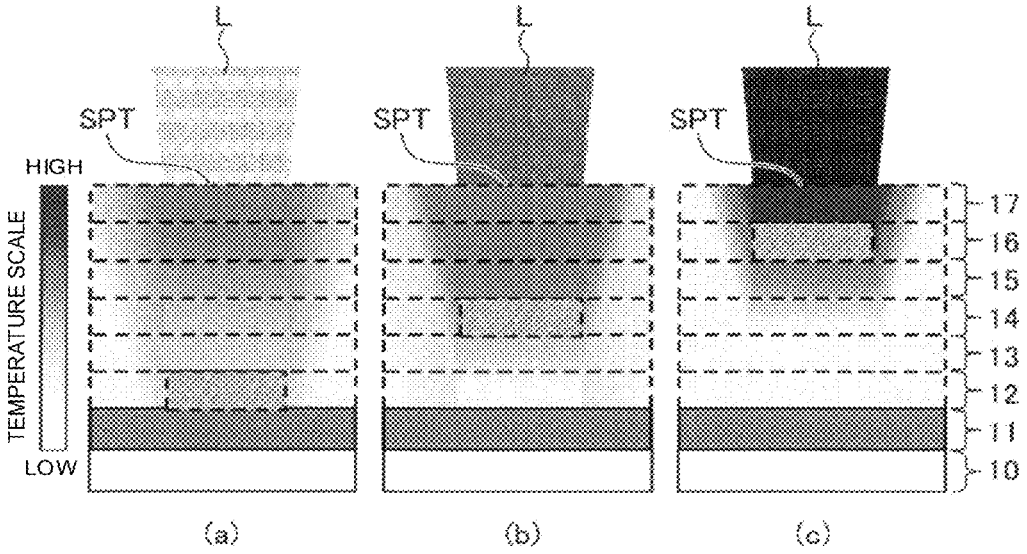
FIG. 2 is a diagram for describing an example of a processing to make the recording medium according to the present embodiment develop color.

Next, an example of a processing for making the recording medium 100 according to the present embodiment develop color will be described using FIG. 1 and FIG. 2. FIG. 2 is a diagram for describing an example of the processing for making the recording medium according to the present embodiment develop color.

As shown in FIG. 1, a laser recording apparatus irradiates the recording medium 100 with laser light L when making the recording medium 100 develop color. At that time, the laser recording apparatus irradiates the recording medium 100 with the laser light L which has been condensed by a lens and so on, to form a laser spot SPT of a prescribed size on the recording medium. Heat generated by the laser light L with which the recording medium 100 has been irradiated is transferred from the laser spot SPT to the yellow color developing layer 16, the magenta color developing layer 14, and the cyan color developing layer 12.

The cyan color developing layer 12, the magenta color developing layer 14, and the yellow color developing layer 16 are clear and colorless in an initial state in which heat is not applied to these layers, but these layers develop respective colors when heat is applied to these layers. In the present embodiment, the yellow color developing layer 16 develops color by heat of a temperature not less than the high temperature threshold value t3, as described above. The magenta color developing layer 14 develops color by heat of a temperature not less than the intermediate temperature threshold value t2. The cyan color developing layer 12 develops color by heat of a temperature not less than the low temperature threshold value t1.

Accordingly, when only the yellow color developing layer 16 of the recording medium 100 is made to develop color, as shown in (c) in FIG. 2, the laser recording apparatus irradiates the recording medium 100 with the laser light L of a first strength from the protective layer 17 side for a first time. The laser light L with which the recording medium 100 has been irradiated is converted into heat by the protective layer 17, and the heat is transferred from the laser spot SPT formed on the protective layer 17 to the yellow color developing layer 16, as heat of a temperature not less than the high temperature threshold value t3. By this means, the yellow color developing layer 16 develops yellow. At this time, the first time when the recording medium 100 is irradiated with the laser light L is made to be a short time, and the heat transfer from the yellow color developing layer 16 to the magenta color developing layer 14 is decreased by the heat insulting layer 15, to prevent the magenta color developing layer 14 from developing color.

In addition, when only the magenta color developing layer 14 of the recording medium 100 is made to develop color, as shown in (b) in FIG. 2, the laser recording apparatus irradiates the recording medium 100 with the laser light L of a second strength that is weaker than the first strength from the protective layer 17 side for a second time that is longer than the first time. The laser light L with which the recording medium 100 has been irradiated is converted into heat by the protective layer 17, and the heat is transferred from the laser spot SPT formed on the protective layer 17 to the magenta color developing layer 14, as heat of a temperature that is not less than the intermediate temperature threshold value t2 and is lower than the high temperature threshold value t3. By this means, the magenta color developing layer 14 develops magenta. At this time, the second time when the recording medium 100 is irradiated with the laser light L is made to be a time during which the heat is not transferred to the cyan color developing layer 12, and the heat transfer from the magenta color developing layer 14 to the cyan color developing layer 12 is decreased by the heat insulting layer 13, to prevent the magenta color developing layer 14 from developing color. Since the temperature of the heat which is transferred in the recording medium 100 is lower than the high temperature threshold value t3, the yellow color developing layer 16 does not develop color.

In addition, when only the cyan color developing layer 12 of the recording medium 100 is made to develop color, as shown in (a) in FIG. 2, the laser recording apparatus irradiates the recording medium 100 with the laser light L of a third strength that is weaker than the second strength from the protective layer 17 side for a third time that is longer than the second time. The laser light L with which the recording medium 100 has been irradiated is converted into heat by the protective layer 17, and the heat is transferred from the laser spot SPT formed on the protective layer 17 to the cyan color developing layer 12, as heat of a temperature that is not less than the low temperature threshold value t1 and is lower than the intermediate temperature threshold value t2. By this means, the cyan color developing layer 12 develops cyan. At this time, the third time when the recording medium 100 is irradiated with the laser light L is made to be a time during which the heat is transferred to the cyan color developing layer 12, to prevent defective color development of the cyan color developing layer 12. Since the temperature of the heat which is transferred in the recording medium 100 is lower than the intermediate temperature threshold value t2, the yellow color developing layer 16 and the magenta color developing layer 14 do not develop color.

Figure 3:
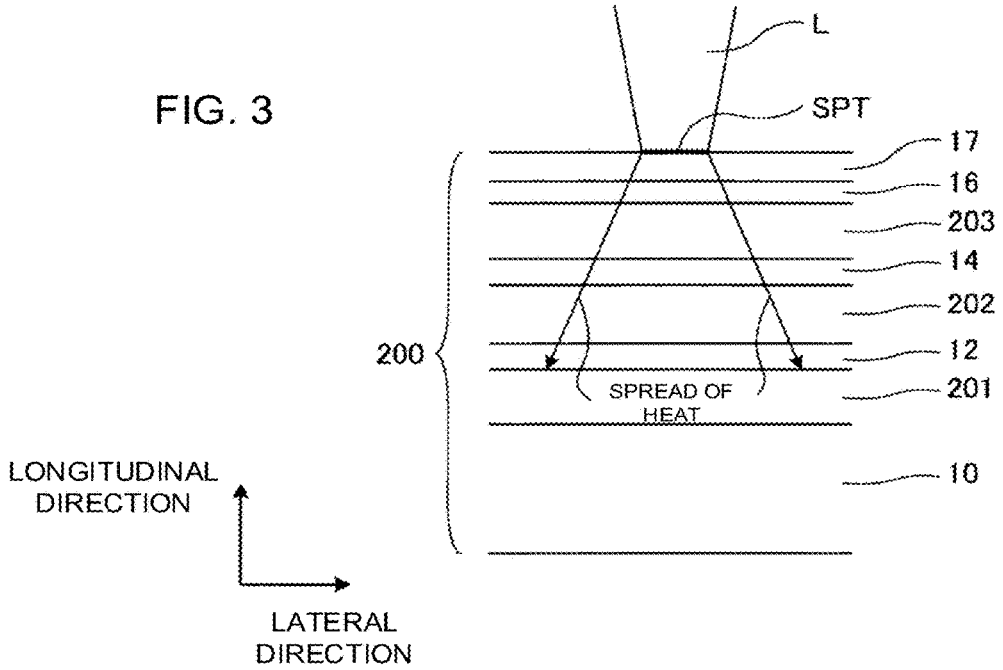
FIG. 3 is a diagram for explaining a problem, at the time of making a recording medium of a comparative example develop color.

Next, a problem at the time of making a recording medium of a comparative example develop color will be described using FIG. 3. FIG. 3 is a diagram for describing the problem, at the time of making the recording medium of the comparative example develop color. As shown in FIG. 3, a recording medium 200 of the comparative example has the substrate 10, and a heat insulating layer 201, the cyan color developing layer 12, a heat insulating layer 202, the magenta color developing layer 14, a heat insulating layer 203, the yellow color developing layer 16, the protective layer 17 which are laminated on the substrate 10 in this order, in the same way as the recording medium 100 of the present embodiment. In the recording medium 200 of the comparative example, heat propagates not only in a direction (hereinafter called a longitudinal direction) in which the heat insulating layer 201, the cyan color developing layer 12, the heat insulating layer 202, the magenta color developing layer 14, the heat insulating layer 203, the yellow color developing layer 16 and the protective layer 17 are laminated, but also in a direction (hereinafter, called a lateral direction) orthogonal to the longitudinal direction. For this reason, it is difficult to make a region of a desired size develop color.

Specifically, when the protective layer 17 is irradiated with the laser light L, as shown in FIG. 3, the laser light L with which the recording medium 200 has been irradiated is converted into heat by the protective layer 17, and the heat is transferred from the laser spot SPT also in the lateral direction. And a range in which the heat is transferred in the lateral direction of the recording medium 200 becomes larger, as a distance from the laser spot SPT in the longitudinal direction becomes larger. For the reason, when the protective layer 17 is irradiated with the laser light L, the yellow color developing layer 16 develops color in a region of a size approximately equal to an area of the laser spot SPT. However, the cyan color developing layer 12 develops color in a region that is larger than the laser spot SPT, and thereby a desired image cannot be recorded. A spot diameter of the light L with which the recording medium 200 is irradiated is determined by a wavelength of the laser light L and performance of a lens, and thereby the spot diameter cannot be made not more than a prescribed spot diameter. Accordingly, in a color developing layer that is distant from the laser spot SPT, in order to make the color developing layer develop color in a region approximately equal to the laser spot SPT, it is necessary to reduce propagation of heat in the lateral direction in the recording medium 200.

Figure 4:
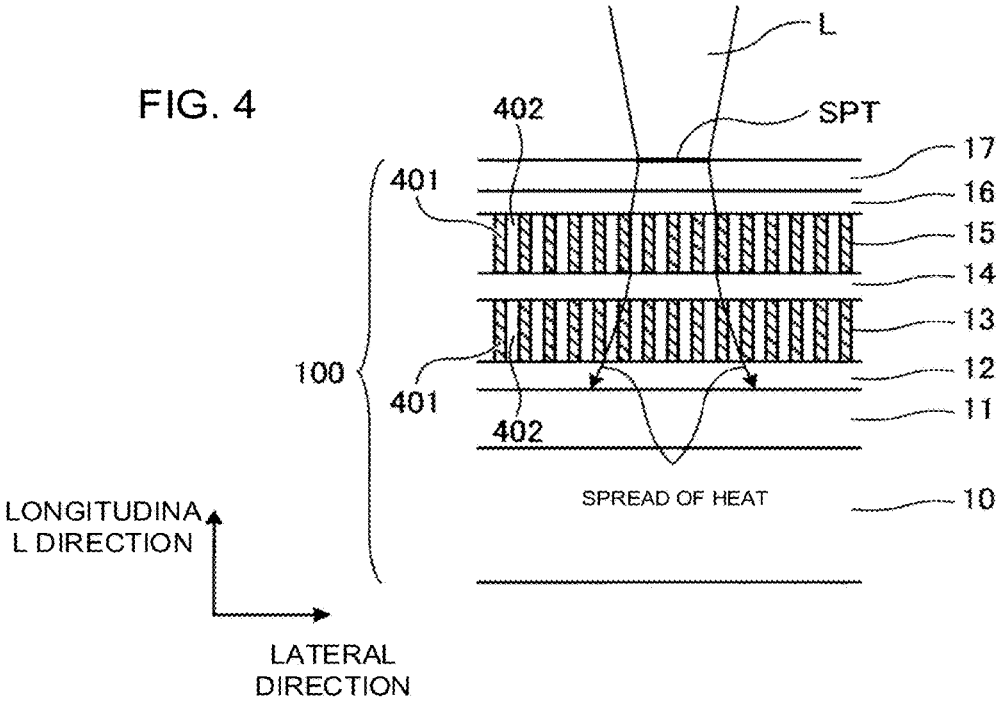
FIG. 4 is a diagram showing an example of a configuration of the heat insulting layer which the recording medium according to the present embodiment has.

In the recording medium 100 of the present embodiment shown in FIG. 4, in the heat insulating layers 13, 15, heat conductivity of the heat in the lateral direction is lower than heat conductivity of the heat in the longitudinal direction. That is, when heat is transferred from the yellow color developing layer 16 to the magenta color developing layer 14, and when heat is transferred from the magenta color developing layer 14 to the cyan color developing layer 12, the heat transfer in the lateral direction is reduced. By this means, since it is possible to transfer heat to a region of a size which is approximately equal to the laser spot SPT, in the magenta color developing layer 14 and the cyan color developing layer 12 which are distant from the laser spot SPT, it is possible to make the color development layer develop color in a region of a size which is approximately equal to the laser spot SPT, in each of the magenta color developing layer 14 and the cyan color developing layer 12.

FIG. 4 is a diagram showing an example of a configuration of the heat insulating layer which the recording medium according to the present embodiment has. The heat insulating layer 13 has the same configuration as the heat insulating layer 15. In the following description, the heat insulating layer 15 will be described. As shown in FIG. 4, in the heat insulating layer 15 which the recording medium 100 of the present embodiment has, first heat insulating layers 401 of a first heat conductivity $\lambda 1$, and second heat insulating layers 402 of a second heat conductivity $\lambda 2$ that is higher than the first heat conductivity $\lambda 1$ are laminated in the lateral direction. That is, the heat insulating layer 15 has a structure in which the heat conductivity in the longitudinal direction is high and the heat conductivity in the lateral direction is low. By this means, when heat is transferred from the yellow color developing layer 16 to the magenta color developing layer 14, since the heat propagation in the lateral direction in the heat insulating layer 15 can be reduced, an area in the lateral direction in which heat is transferred is approximated to the area of the laser spot SPT in the magenta color developing layer 14, and accordingly, it is possible to form an image of a size that is approximate to the area of the laser spot SPT.

In addition, in the present embodiment, a thickness of the first heat insulating layer 401 in the lateral direction is not more than a half of a spot diameter of the laser spot SPT of the laser light L with which the recording medium 100 is to be irradiated. In addition, a thickness of the second heat insulating layer 402 in the lateral direction is not more than a half of the spot diameter of the laser spot SPT of the laser light L with which the recording medium 100 is to be irradiated. And as shown in FIG. 4, in the heat insulating layer 15, the first heat insulating layers 401 and the second heat insulating layers 402 are alternately laminated in the lateral direction. That is, at least one of the first heat insulating layers 401 is contained in a region of the heat insulating layer 15 in which heat is propagated from the yellow color developing layer 16, and the first insulating layers 401 and the second insulating layers 402 exist mixedly in the heat insulating layer 15. By this means, it is possible to prevent that deviation in regions in which heat is propagated in the longitudinal direction is generated in the heat insulating layer 15, and accordingly, in the magenta color developing layer 14, a shape of a region in which heat is transferred is approximated to the shape of the laser spot SPT of the laser light L, and thereby it is possible to form an image approximate to the shape of the relevant laser spot SPT.

Figure 5:
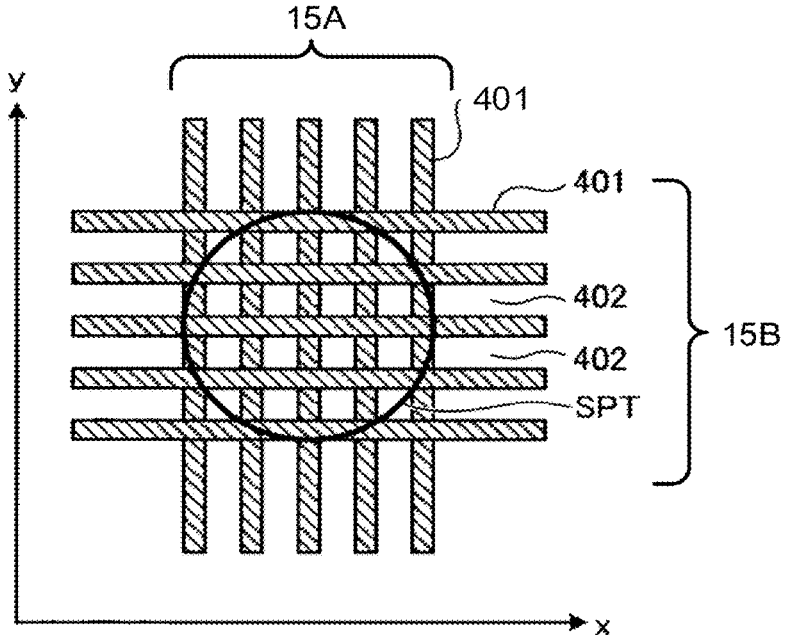
FIG. 5 is a diagram showing an example of a configuration of the heat insulting layer which the recording medium according to the present embodiment has.

FIG. 5 is a diagram showing an example of a configuration of the heat insulating layer which the recording medium according to the present embodiment has. In the present embodiment, a plurality of the first heat insulating layers 401 are provided in a lattice shape in the lateral direction, as shown in FIG. 5. And a size (a length of one side of a lattice) of a lattice formed by the first heat insulating layers 401 is not more than a half of the spot diameter of the laser spot SPT of the laser light L with which the recording medium 100 is to be irradiated. And the second heat insulating layers 402 are respectively provided in openings of the first insulating layers 401 formed in a lattice shape.

Specifically, in the heat insulating layer 15, a first layer 15A and a second layer 15B are laminated in the longitudinal direction. In the first layer 15A, the first heat insulating layers 401 and the second heat insulating layers 402 are alternately laminated in an x-axis direction (an example of a third direction) out of the lateral direction. And in the second layer 15B, the first heat insulating layers 401 and the second heat insulating layers 402 are alternately laminated in a y-axis direction (an example of a fourth direction) orthogonal to the x-axis direction out of the lateral direction. By this means, when the heat insulating layer 15 is seen from an irradiation source of the laser light L, a plurality of the first heat insulating layers 401 of the second layer 15B and a plurality of the first heat insulating layers 401 of the first layer 15A are provided in a lattice shape in the lateral direction.

Figure 6:
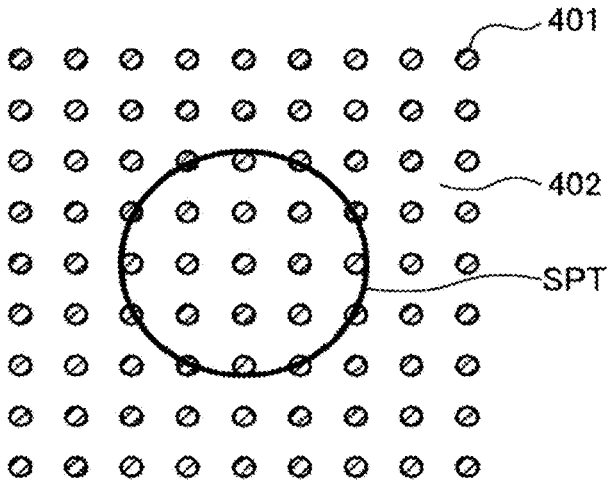
FIG. 6 is a diagram showing an example of a configuration in which a first heat insulating layer of the heat insulting layer which the recording medium according to the present embodiment has is composed of air.

In the heat insulating layer which the recording medium according to the present embodiment has, the first heat insulating layers 401 are provided in a lattice shape in the lateral direction, but without being limited to this, the second heat insulating layers 402 may be provided in a lattice shape in the lateral direction. In this case, the first heat insulating layers 401 are respectively provided in openings of the second heat insulating layers 402 formed in a lattice shape. FIG. 6 is a diagram showing an example of a configuration in which the first heat insulating layers of the heat insulating layer which the recording medium according to the present embodiment has are composed of air. In the present embodiment, the first heat insulating layers 401 are composed of air existing in openings of the second heat insulating layers 402 that are formed in a lattice shape in the lateral direction (a plane direction) orthogonal to the longitudinal direction. Here, the first heat insulating layer 401 is formed of air, but the first heat insulating layer 401 has only to be formed of a member having heat conductivity that is lower than the second heat insulating layer 402.

Figure 7:
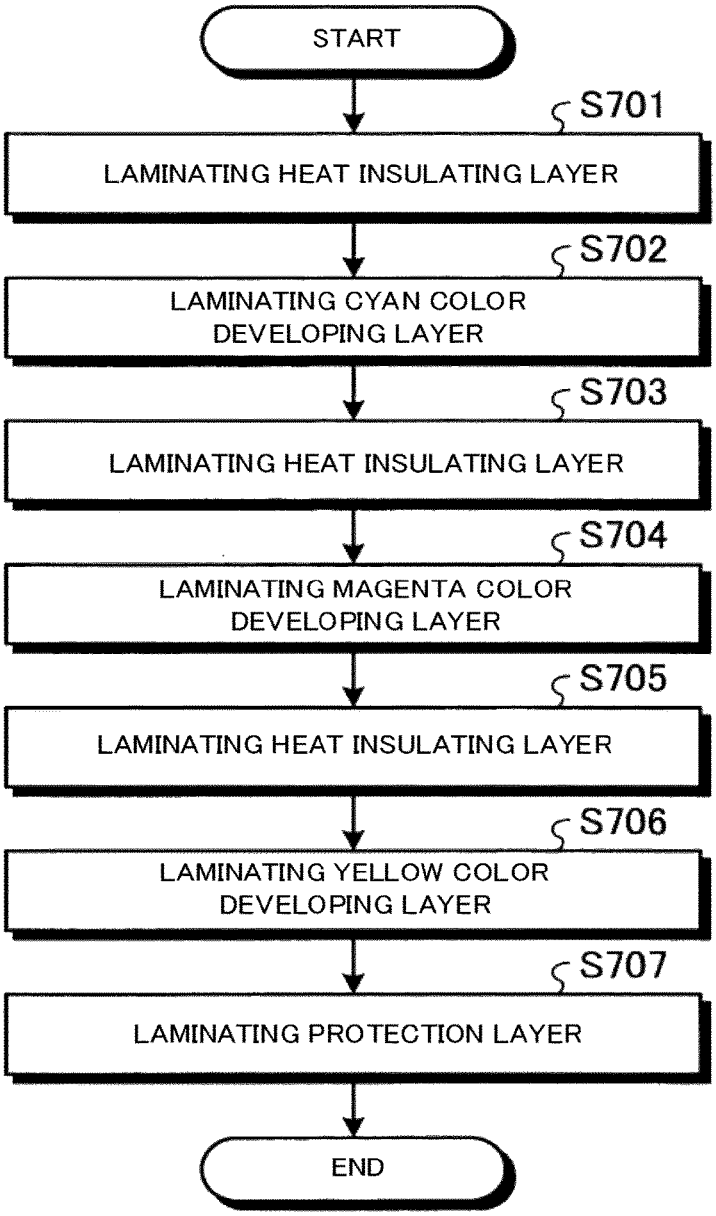
FIG. 7 is a diagram showing an example of a flow chart indicating a method for manufacturing the recording medium according to the present embodiment.

Next, an example of a flow of a manufacturing method of the recording medium 100 according to the present embodiment will be described using FIG. 7. FIG. 7 is a diagram showing an example of a flow chart indicating the method for manufacturing the recording medium according to the present embodiment.

As shown in FIG. 7, a manufacturing apparatus to manufacture the recording medium 100 according to the present embodiment firstly prepares the substrate 10, and laminates the heat insulating layer 11 on the substrate 10 (step S701). Next, the manufacturing apparatus laminates the cyan color developing layer 12 on the heat insulating layer 11 (step S702). Next, the manufacturing apparatus laminates the heat insulating layer 13 on the cyan color developing layer 12 (step S703). The manufacturing apparatus laminates a first layer and a second layer on the cyan color developing layer 12 like the heat insulating layer 15 shown in FIG. 5. Here, the first layer and the second layer are respectively formed by laminating the first insulating layers 401 and the second insulating layers 402 in the lateral directions orthogonal to the longitudinal direction in which the cyan color developing layer 12 has been laminated.

Next, the manufacturing apparatus laminates the magenta color developing layer 14 on the heat insulating layer 13 (step S704). Next, the manufacturing apparatus laminates the heat insulating layer 15 on the magenta color developing layer 14 (step S705). At the time of laminating the heat insulating layer 15, the manufacturing apparatus forms the heat insulating layer 15 by laminating the first layer 15A and the second layer 15B which have been respectively formed by laminating the first heat insulating layers 401 and the second heat insulating layers 402 in the lateral direction, in the same manner as in the heat insulating layer 13.

Then, the manufacturing apparatus laminates the yellow color developing layer 16 on the heat insulating layer 15 (step S706). Finally, the manufacturing apparatus laminates the protective layer 17 on the yellow color developing layer 16, to manufacture the recording medium 100 (step S707).

In this manner, according to the recording medium 100 according to the present embodiment, in the recording medium 100 in which a plurality of the color developing layers are laminated, prescribed heat insulating layers are respectively provided between a plurality of the color developing layers. Accordingly, in the color developing layer existing at a position distant from the laser spot SPT to be irradiated with the laser light L, it is possible to form an image of a size approximate to the size of the laser spot SPT.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A recording medium, comprising:

a substrate;

a first color developing layer which is stacked on the substrate and develops a first color at a temperature not less than a first threshold value;

a heat insulating member stacked on the first color developing layer; and a second color developing layer which is stacked on the heat insulating member and develops a second color that is different from the first color at a temperature not less than a second threshold value that is higher than the first threshold value;

wherein the heat insulating member has a first member and a second member which is stacked on the first member in a first direction in which the first color developing layer, the heat insulating member, and the second color developing layer are stacked on the substrate, wherein the first member has a plurality of first heat insulating layers each having a first heat conductivity and a plurality of second heat insulating layers each having a second heat conductivity that is higher than the first heat conductivity, and the first heat insulating layers and the second heat insulating layers are alternately stacked in a second direction that is orthogonal to the first direction, wherein the second member has a plurality of third heat insulating layers each having the first heat conductivity and a plurality of fourth heat insulating layers each having the second heat conductivity, and the third heat insulating layers and the fourth heat insulating layers are alternately stacked in a third direction that is orthogonal to the first direction and that is orthogonal to the second direction, respectively, and wherein a thickness of each of the first heat insulating layers and a thickness of each of the second heat insulating layers in the second direction are not more than a half of a spot diameter of a beam spot of laser light with which the recording medium is to be irradiated.

2. The recording medium according to claim comprising:

a protective layer on the second color developing layer.

* * * * *